US006203358B1

(12) United States Patent
Kasai

(10) Patent No.: US 6,203,358 B1
(45) Date of Patent: Mar. 20, 2001

(54) ELECTRICAL CONNECTION BOX AND A METHOD FOR MANUFACTURING SUCH AN ELECTRICAL CONNECTION BOX

(75) Inventor: Koji Kasai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/468,036

(22) Filed: Dec. 21, 1999

(30) Foreign Application Priority Data

Dec. 22, 1998 (JP) ..... 10-365584

(51) Int. Cl.[7] ..... H01R 11/20
(52) U.S. Cl. ..... 439/404; 439/947
(58) Field of Search ..... 439/76.2, 404, 439/949, 210–213; 361/360, 361, 395

(56) References Cited

U.S. PATENT DOCUMENTS 4,689,718 8/1987 Maue et al. ..... 361/360
5,653,607 * 8/1997 Saka et al. ..... 439/402
5,928,004 * 7/1999 Sumida et al. ..... 439/76.2
6,015,302 * 1/2000 Butts et al. ..... 439/76.2

FOREIGN PATENT DOCUMENTS 08065858 3/1996 (JP) .
09308049 11/1997 (JP) .

* cited by examiner

*Primary Examiner*—Brian Sircus
*Assistant Examiner*—Son V. Nguyen
(74) *Attorney, Agent, or Firm*—Anthony J. Casella; Gerald E. Hespos; Michael J. Porco

(57) ABSTRACT

An electrical connection box is provided for an automotive vehicle. The box can flexibly cope with a design change or the like. Internal circuits of the electrical connection box are formed by wires and push-in terminals that are provided on the inner surfaces of lower and upper casings 11, 12. A plurality of through holes 11*a'*, 12*a'* in which connectors 19 are detachably mountable are formed in the lower and upper casings 11, 12, the connectors carrying push-in terminals in conformity with a circuit construction are fixedly fitted into the through holes 11*a'*, 12*a*'. The push-in terminals are connected with the wires as well as with external circuits.

7 Claims, 6 Drawing Sheets

ELECTRICAL CONNECTION BOX AND A METHOD FOR MANUFACTURING SUCH AN ELECTRICAL CONNECTION BOX

BACKGROUND OF THE INVENTION

1. Field of the Invention

The present invention relates to an electrical connection box and a method for manufacturing such an electrical connection box. The invention particularly is designed to enhance a range of application and to deal flexibly with a circuit change in an electrical connection box, such as a junction box, that is to be incorporated into an automotive harness.

2. Description of the Related Art

A prior art electrical connection box, such as a junction box, has branch circuits accommodated at high density. Internal circuits are formed by a combination of wires and push-in terminals or by wires, push-in terminals and a busbar. These internal circuits may be arranged in different layers with insulating plates or the like provided between the layers of internal circuits. Internal circuits in the prior art electrical connection box are connected with external circuits by special connectors provided in the upper casing and the lower casing.

A prior art electrical connection box, as described above, is shown in FIG. 8. This prior art electrical connection box has a layered array comprising a strand of wire (single core wire) as a bottommost layer, a first insulating plate 6, a busbar 7, and a second insulating plate 8 and another strand of wire as an uppermost layer. The wire in the bottommost layer of the lower casing 1 is connected to the wire in the uppermost layer of the upper casing 2 by placing the lower casing 1 and the upper casing 2 side by side on the same plane and then laying a strand of wire w on and between the casings 1 and 2 as shown in FIG. 9. The upper casing 2 then is turned onto the lower casing 1 and fitted thereto.

The lower and upper casings 1 and 2 are formed integrally with connectors 3, relay sockets 4 and fuse sockets 5 for connection with external circuits. Push-in terminals 5 are inserted into the connectors 3. The push-in terminals 5 each have a connection portion 5*a* formed at one end for the connection with the wires w and for the connection with the external circuit. Push-in terminals also are inserted into the relay sockets 4 and fuse sockets 5 which are to be connected with the wire w.

The connectors 3 are formed integrally with the lower casing 1 and the upper casing 2 as described above. Thus coupling positions of wiring harnesses to be connected with the external circuits are restricted. This is a hindrance to a change in circuit design. Further, due to the restrictions, one kind of prior art electrical connection box can be used for limited types of vehicles and specifications, and may be not used for another type of vehicles and specifications.

The insertion positions of the push-in terminals 5 are restricted by the positions of the connectors 3. Hence even if the prior art electrical connection boxes are for the same type of vehicles, the wires w and the push-in terminals 5 may not be connected if the layout pattern of the wires w is changed due to a change in the internal circuits resulting from an improvement in function, because this makes it difficult to change and add circuits. To avoid these problems, the lower and upper casings need to be newly designed every time the type of vehicle is changed and/or the circuits are changed. However, this disadvantageously leads to huge production costs for the fabrication of molds.

As noted above the wire is laid in the lower and upper casings 1 and 2 that have been placed on the same plane, as shown in FIG. 9 in the manufacturing process of the electrical connection box. Consequently wire portions w-a that connect the wires in the upper and the lower layers may bulge out from the casing when the lower and upper casings 1 and 2 are assembled.

The present invention was developed in view of the above problems, and an object thereof is to prevent wires constructing internal circuits from bulging out during a manufacturing process of an electrical connection box.

SUMMARY OF THE INVENTION

According to the invention, there is provided an electrical connection box, comprising internal circuits formed by wires and push-in terminals. The internal circuits are provided on the inner sides of a first or lower casing and a second or upper casing. A plurality of through holes are formed in the first or lower casing and/or the second or upper casing for receiving connectors. The connectors may have push-in terminals mounted thereon and may be mounted fixedly in the through holes in accordance with a circuit construction. Thus the push-in terminals are connected with the wires and preferably are connected with an external circuit. Accordingly, the present invention can accommodate different types and specifications of vehicles or easily can accommodate a design change by employing a first or lower casing and a second or upper casing of one type.

If the through holes into which the connectors are detachably mountable are formed in the first or lower casing and second or upper casing, the connectors can be mounted in necessary positions in accordance with the circuit construction. Thus the electrical connection box can be used for a wider range of vehicles without being limited to one type of vehicle. Further, since the layout patterns of the wires to be connected with the push-in terminals mounted in the connectors can be changed easily, circuits also can be changed easily and/or added. Therefore, a circuit change can be realized very easily in accordance with a change in the mount positions of the connectors, with the result that the electrical connection box can be used for many types of vehicles.

Preferably, at least one busbar is arranged between the upper and lower wires while substantially providing insulating plates between the busbar and the upper and lower wires. Tabs project from the busbar and are connectable with the connectors and relays and fuses to be mounted in the second or upper casing and/or the first or lower casing.

If the circuit formed by the busbar is used in addition to the circuits formed by the wires and the push-in terminals, a circuit corresponding to a current amount can be constructed.

Preferably, the second or upper casing and/or the first or lower casing are formed with through holes into which the relays and fuses are detachably mountable. Push-in terminals are mounted for connection with the wires and/or the tabs of the busbar and for connection with the relays and/or fuses to be mounted into these through holes. If the mount positions of the relays and/or fuses can be changed easily as well as those of the connectors, the same electrical connection box can be used for different circuit constructions, thereby enhancing a flexibility.

Preferably, the wires laid in the upper or second layer and the lower or first layer are or can be connected by at least one connection busbar to be mounted along one side surface of the casing. If the wires laid in the first or lower casing and the second or upper casing are connected by the connection busbar mounted on the side surface of the casing, the corresponding wires in the first or lower casing and second or upper casing need not be continuous. This solves the problem of the prior art that the folded portions of the strand of wire bulge out of the casing. Alternatively, the wires can be separately laid in the first or lower and second or upper casings, thereby making it easier to lay the wires.

According to the invention, there is further provided a method for manufacturing an electrical connection box, comprising laying a plurality of wires on inner surfaces of first and second casings. The method continues by mounting at least one connection busbar on at least one side surface of the first and second casings such that second and first wires are connected to the respective second and first ends of the connection busbar.

According to a preferred embodiment, the method comprises a step of cutting a strand of wire that has laid between the first and second casings that have been placed substantially side by side. Alternatively the method may comprise individually laying wires in the first and second casings.

These and other objects, features and advantages of the present invention will become more apparent upon a reading of the following detailed description and accompanying drawings.

DETAILED DESCRIPTION OF THE PREFERRED EMBODIMENT

Figure 1:
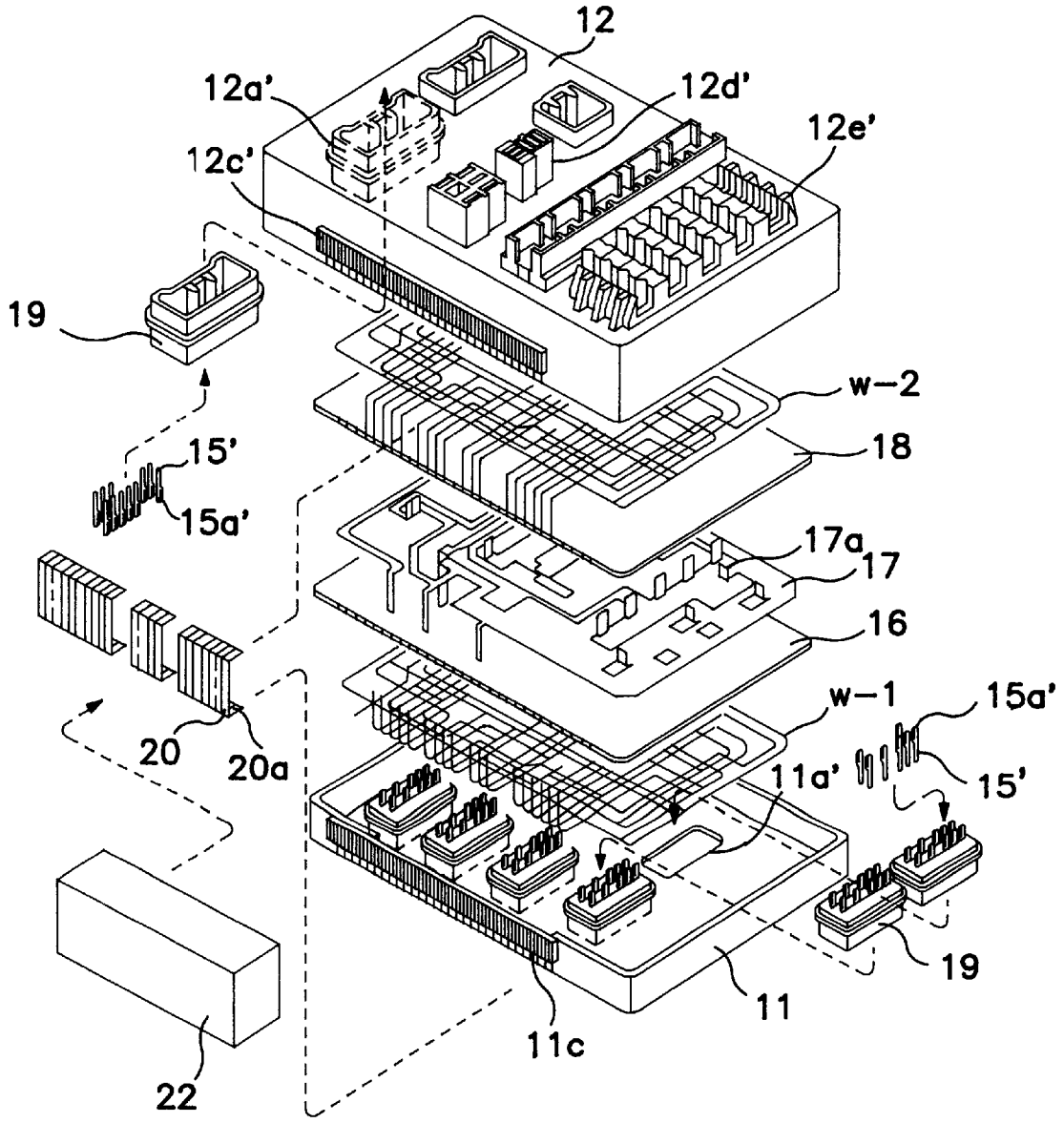
FIG. 1 is a perspective view showing one embodiment of the present invention.

A casing assembly of an electrical connection box of the present invention is comprised of a lower casing 11 and an upper casing 12 as shown in FIG. 1. A layered internal circuit is placed in the casing, and comprises wires w-1 as a bottommost layer, a first insulating plate 16, a busbar 17 and a second insulating plate 18, all placed one over another in this order. Wires w-2 then are laid in an uppermost layer. Female connectors 19 are fitted or fittable as separate members in the lower and/or upper casings 11 and 12, and push-in terminals 15' are inserted or insertable into the female connectors 19 for connection with the wires w-1 and w-2 inside the casing. The wires w-1 and w-2 are connected via connection busbars 20 mounted on one surface of the lower and upper casings 11 and 12.

Figure 2:
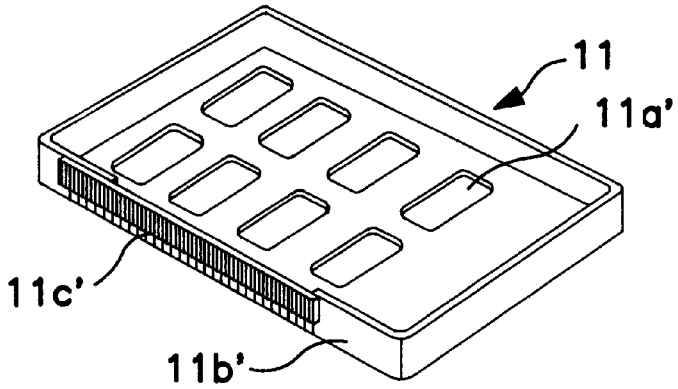
FIG. 2 is a perspective view of a lower casing.

The lower casing 11 shown in FIG. 2 is integrally or unitarily formed of a nonconductive material, such as a resin and has a bottom wall formed with through holes 11*a*' into which the female connectors 19 are fittable. The through holes 11*a*' preferably are formed to fit a maximum number of the female connectors 19 while maintaining a sufficient strength of the lower casing 11. The through holes 11*a*' need not be arranged in this way, but it is preferable to provide a maximum possible number of through holes to accommodate a circuit change with flexibility. The dimensions of the through holes 11*a*' substantially correspond to the outer configuration of the female connectors 19 to ensure secure fitting. Further, a guide lock 11*c*' is provided on one side surface 11*b*' to allow the passage of the wires and to enable mounting of the connection busbars 20.

Figure 3A:
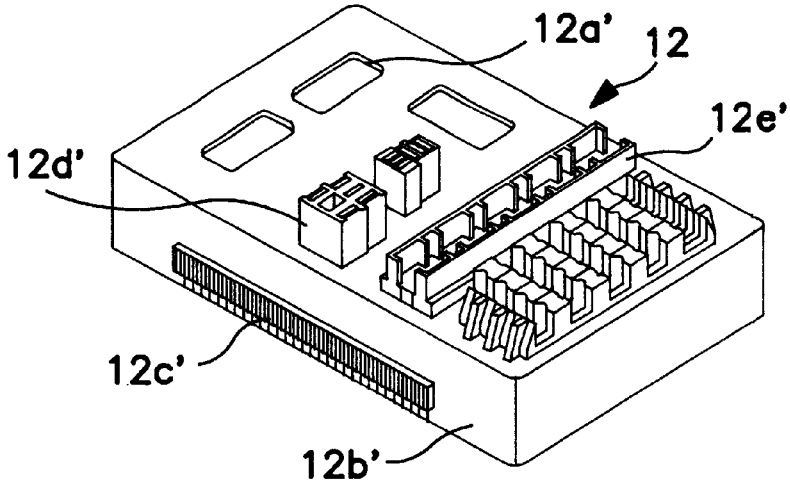
FIG. 3(A) is a perspective view of an upper casing.

The upper casing 12 shown in FIG. 3(A) also is formed integrally of a resin, and has upper surface with through holes 12*a*' into which the female connectors 19 are fitted. Sockets 12*d*', 12*e*' are integrally formed with the casing 12 and are used for the insertion of relays and fuses. A maximum possible number of through holes 12*a*' are arranged efficiently in an area which is not taken up by the sockets 12*d*' and 12*e*'. The dimensions of the through holes 12*a*' are set in the same way as in the case of the lower casing 11. A guide lock 12*c*' also is provided on one side surface 12*b*' of the upper casing 12 to allow the passage of the wires and on which the connection busbars 20 are mountable.

Figure 3B:
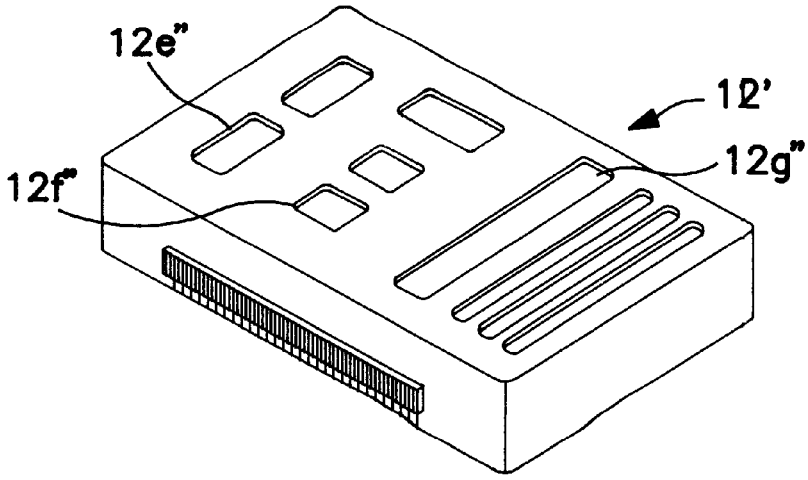
FIG. 3(B) is a perspective view according to a modification of the upper casing.

The relay and fuse sockets may be separately formed from the upper casing 12 to accommodate a circuit change or the like with greater flexibility. As shown in FIG. 3(B), through holes 12*e*' for the female connectors 19, fitting holes 12*f*' for the relay sockets and fitting holes 12*g*' for the fuse sockets may be formed in an upper casing 12'.

Figure 4A:
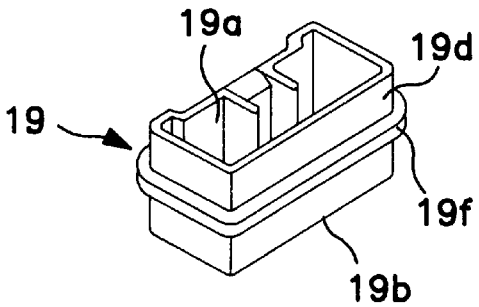
FIG. 4(A) is a perspective view of a connector viewed from above.
Figure 4B:
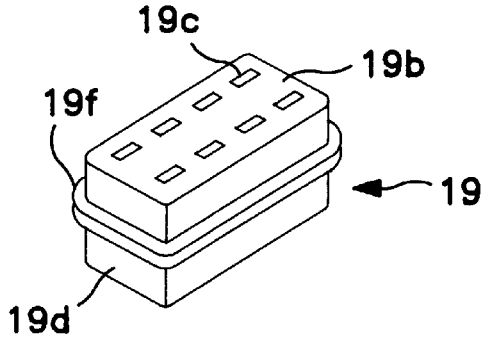
FIG. 4(B) is a perspective view of the connector viewed from below.

The female connectors 19 to be fitted into the through holes 11*a*' and 12*a*' may be made of a resin and are substantially in the form of a rectangular parallelepiped as shown in FIGS. 4(A) and 4(B). A fitting portion 19*a* is provided at one side surface to be connected with a mating male connector. A specified number of insertion holes 19*c* for the push-in terminals are formed in a bottom surface 19*b*. A jaw portion 19*f* projects from an outer substantially circumferential wall 19*d* to fit the female connectors 19 substantially stably into the through holes 11*e* and the like of the lower casing 11. In the event that sealability is required for the fitting portions 19*a*, the female connector 19 may be fitted into the through holes 11*a*' or 12*a*' of the lower casing 11 or upper casing 12 after a packing member such as a rubber packing is mounted on the outer circumferential wall 19*d* and the jaw portion 19*f* of the female connector 19.

Although the female connectors 19 of the same size are used in all positions of the lower and upper casings 11 and 12, those having different sizes may be used in conformity with the shape of the male connectors of external circuits. In such an instance, the dimensions of the through holes 11*a*' and 12*a*' in the lower and upper casings 11 and 12 suitably are set substantially in conformity with the female connectors of different sizes. Further, in the event that relay sockets of different sizes are separately provided, the fitting holes 12*f*' and 12*g*' of different sizes may be formed suitably as shown in FIG. 3(B).

Figure 5:
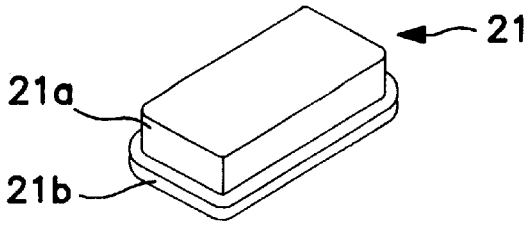
FIG. 5 is a perspective view of a closing lid.
Figure 6:
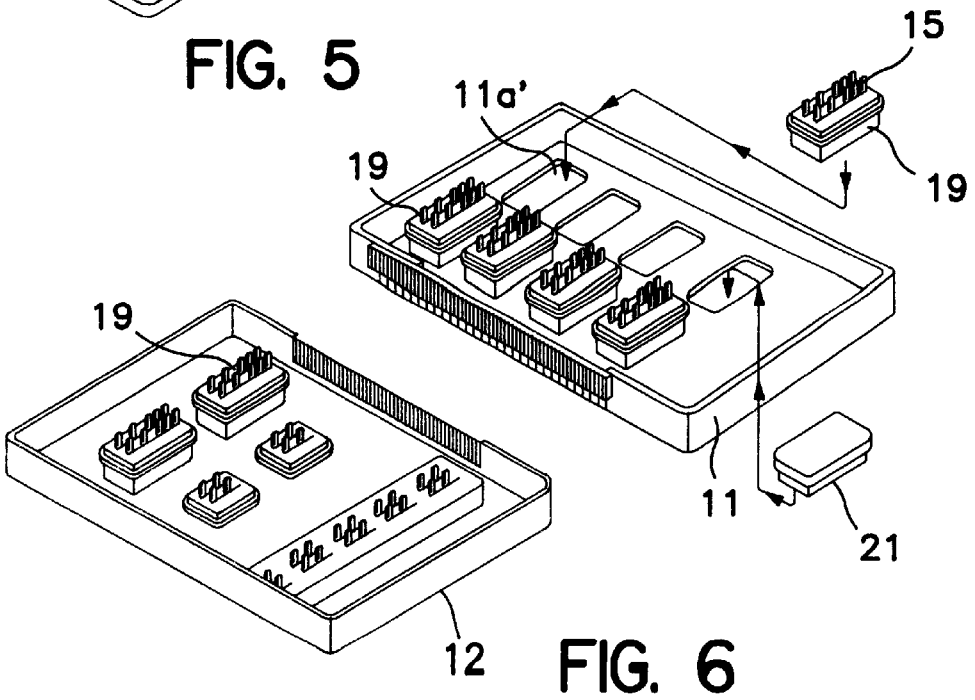
FIG. 6 is a perspective view showing a state how the connectors and the closing lid are mounted in the upper and lower casings.

FIG. 5 shows a closing lid 21 for closing the through holes 11*a*' or 12*a*' of the lower or upper casing 11 or 12 into which the female connector 19 is not fitted. The closing lid 21 is made, for example, of a resin or rubber, and includes an insertion portion 21*a* having dimensions corresponding to those of the through hole 11*a*' or 12*a*' and a fixing portion 21*b* in the form of a jaw.

Manufacture the electrical connection box with the lower and upper casings 11 and 12 involves inserting a necessary number of push-in terminals 15' into insertion holes 19*c* of the female connectors 19 such that connection portions 15*a*' thereof project from the bottom surface 19*b*. Subsequently, the female connectors 19 that carry the push-in terminals 15' are fitted into the through holes 11*a*' and 12*a*' of the lower and upper casings 11 and 12 to positions where the jaw portions 19*f* are in contact with the surfaces of the casing from the inside of the casing. In these positions, the fitting portions 19*a* that are to be connected with the male connectors are located outside the casing and slots of the connection portions 15*a*' project inwardly. In this state, the female connectors 19 preferably are fixed completely to the casing e.g. by welding, respectively. It should be noted that welding may not be performed if the female connectors 19 can be fixed securely only by being fitted into the through holes. The through holes 11*a*' not in use are sealed by mounting the closing lid 21.

Figure 7:
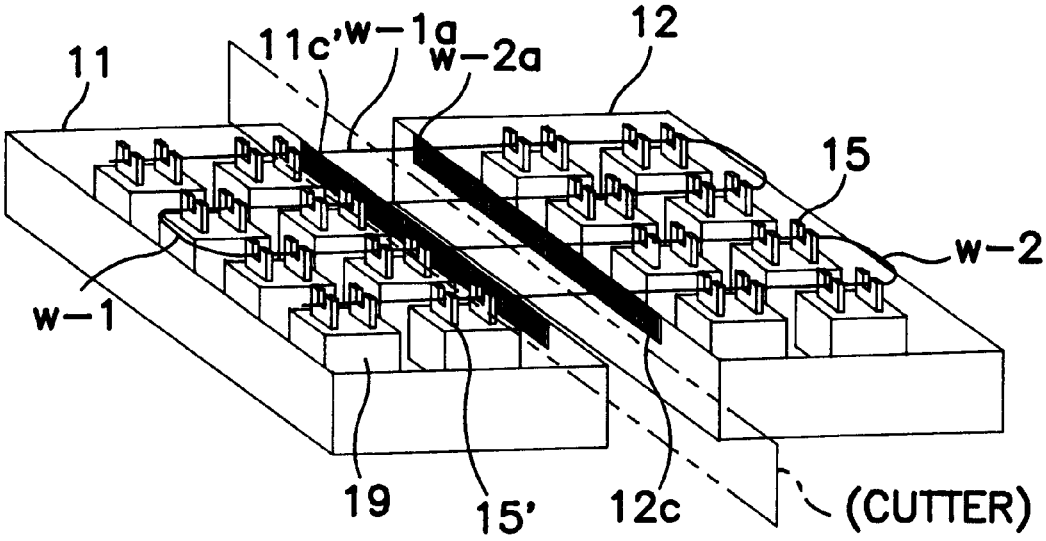
FIG. 7 is a perspective view showing a wire laid on the upper and lower casings.
Figure 8:
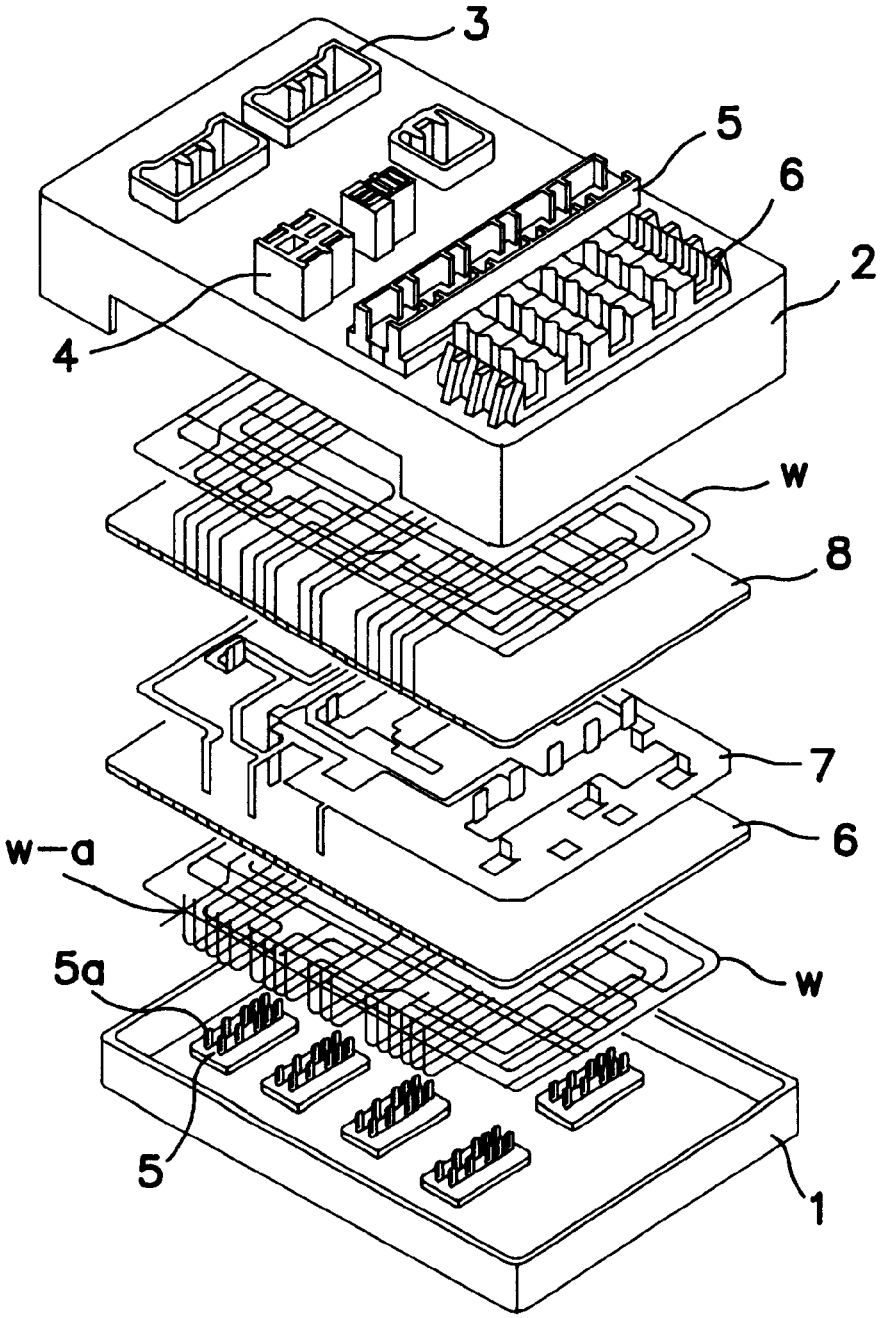
FIG. 8 PRIOR ART
FIG. 8 is a perspective view showing the prior art electrical connection box.
Figure 9:
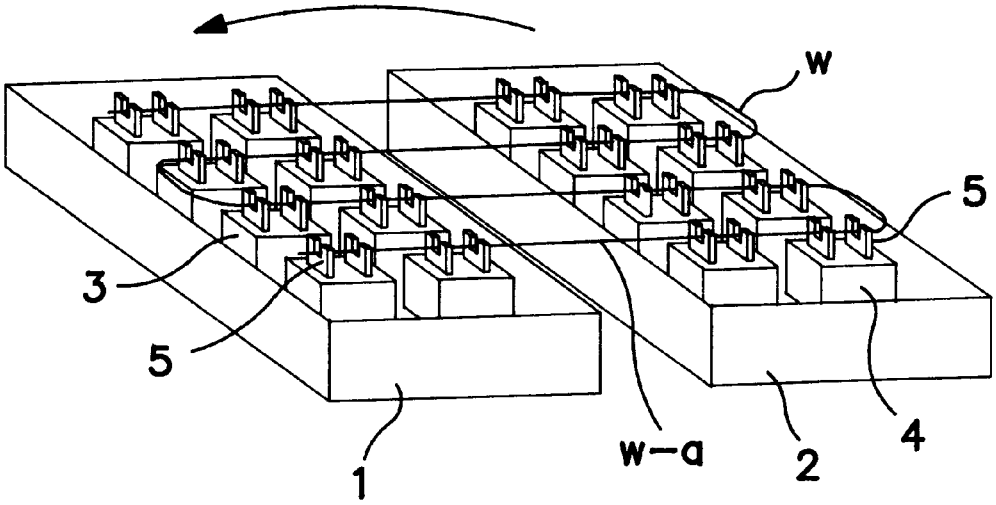
FIG. 9 PRIOR ART
FIG. 9 is a perspective view showing a state where a strand of wire is laid on upper and lower casings of the prior art electrical connection box.

Next, as shown in FIG. 7, the lower and upper casings 11 and 12 are placed substantially side by side on the same plane with their inside faced upwardly and the guide lock 11*c*' of the lower casing 11 and the guide lock 12*c*' of the upper casing 12 opposed to each other. A strand of wire (single core wire) w then is laid and connected with the connection portions 15*a*' of the push-in terminals 15' that project upwardly in this state. The wire w then is cut into wires w-1 and w-2 as shown in phantom line in FIG. 7.

Thereafter, the first insulating plate 16, the busbar 17 and the second insulating plate 18 are arranged, such that the connection portions 17*a* which project from ends of the busbar 17 are connected with the wires w-1 and w-2. The lower and upper casings 11 and 12 then are assembled to hold the first insulating plate 16 and the like therebetween. Finally, portions of the wires w-1 and w-2 which need to be connected are pushed into connection portions 20*a* formed at the bent opposite ends of the connection busbars 20 for the connection by mounting the connection busbars 20 on the guide locks 11*c*' and 12*c*' of the lower and upper casings 11 and 12. A cover 22 is so mounted on one side surface of the lower and upper casings 11 and 12 as to cover the connection busbars 20.

As is clear from the above description, a variety of circuit arrangements can be realized in the electrical connection box of the present invention since the female connectors to be connected with the external circuits are separated formed from the lower and upper casings. Thus, a degree of freedom in circuit design is increased and one kind of electrical connection box can be used for different types and specifications of vehicles. Therefore, a circuit change which might be made later on can be accommodated flexibly.

Further, the number of molds required to manufacture the lower and upper casings can be reduced, and the female connectors can be used for a variety of electrical connection boxes by being treated as standard parts to widen a range of application. A necessary number of parts can be reduced remarkably, and production costs of the electrical connection box can be reduced.

Further, the wires do not project out of the casing in the production process of the electrical connection box by dividing the wires into two. As a result that labor and time required to treat the projecting wires can be reduced.

What is claimed is:

1. An electrical connection box, comprising first and second casings having inner surfaces in opposed facing relationship, outer surfaces facing away from one another and side surfaces extending between the outer surfaces, internal circuits which comprise wires provided between the inner surfaces of the first and second casings, a plurality of through holes being formed in the first and second casings, connectors having push-in terminals mounted therein, the connectors being mounted in at least selected ones of the through holes in accordance with circuit requirements, the push-in terminals in the connectors being connected with the wires and enabling connection to an external circuit at least one connection busbar mounted along at least one of said side surfaces of the casing and providing connection between selected wires in the casing.

2. The electrical connection box according to claim 1, wherein the wires comprise upper wires and lower wires, a busbar being arranged between the upper and lower wires, insulating plates disposed respectively between the busbar and the upper and lower wires, tabs projecting from the busbar and being connectable with the connectors, relays and fuses being mountable in the first and/or second casings.

3. The electrical connection box according to claim 2, wherein the casings are formed with through holes into which the relays and fuses are detachably mountable, and the push-in terminals being mounted in the relays and fuses for mounting in the through holes so as to be connected with the wires and the tabs of the busbar.

4. The electrical connection box according to claim 1, wherein a cover made of an insulating resin is mounted over the connection busbar(s) on the side surfaces of the casings.

5. The electrical connection box according to claim 1, further comprising at least one busbar, an insulating plate between the busbar and a circuit formed by the wires in the first casing and another insulating plate between the busbar and a circuit formed by a combination of the wires in the second casing and bladed terminals.

6. A method for manufacturing an electrical connection box, comprising the following steps:

providing first and second casings, each said casing having an inner surface;

laying at least first and second wires on the inner surfaces of the first and second casings respectively;

engaging the first and second casings such that the first and second wires are between the respective first and second casings; and mounting at least one connection busbar on at least one side surface of the first and second casings such that the second and first wires are connected the connection busbar.

7. The method according to claim 6, wherein placing the first and second casing such that the inner surfaces thereof face upwardly and such that the first and second casings are substantially side by side, laying a single strand of wire between the first and second casings placed substantially side by side, and cutting the single strand of wire between the casings for forming the first and second wires.

* * * * *